US010971108B2

(12) United States Patent
Chu et al.

(10) Patent No.: US 10,971,108 B2
(45) Date of Patent: Apr. 6, 2021

(54) IMAGE DISPLAY METHOD AND APPARATUS, ELECTRONIC DEVICE, VR DEVICE, AND NON-TRANSITORY COMPUTER READABLE STORAGE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Minglei Chu, Beijing (CN); Lili Chen, Beijing (CN); Hao Zhang, Beijing (CN); Zehua Dong, Beijing (CN); Guixin Yan, Beijing (CN); Jinghua Miao, Beijing (CN)

(73) Assignees: Beijing BOE Optoelectronics Technology Co., Ltd., Beijing (CN); BOE Technology Group Co., Ltd., Beiiine (CN)

( * ) Notice: Subject to any disclaimer, the term of this patent is extended or adjusted under 35 U.S.C. 154(b) by 0 days.

(21) Appl. No.: 16/523,118

(22) Filed: Jul. 26, 2019

(65) Prior Publication Data

US 2020/0211494 A1 Jul. 2, 2020

(30) Foreign Application Priority Data

Jan. 2, 2019 (CN) ..... 201910001425.7

(51) Int. Cl.
*G09G 5/00* (2006.01)
*G09G 3/20* (2006.01)

(52) U.S. Cl.
CPC ..... *G09G 5/003* (2013.01); *G09G 3/2092* (2013.01); *G09G 2320/0247* (2013.01); *G09G 2360/12* (2013.01); *G09G 2360/18* (2013.01)

(58) Field of Classification Search
None
See application file for complete search history.

(56) References Cited

U.S. PATENT DOCUMENTS

2004/0207644 A1* 10/2004 MacInnis ..... H04N 21/42653 345/629
2007/0109296 A1* 5/2007 Sakagawa ..... G06T 19/00 345/419

(Continued)

FOREIGN PATENT DOCUMENTS

CN 105957006 A 9/2016
CN 105976424 A 9/2016

(Continued)

*Primary Examiner* — YuJang Tswei
(74) *Attorney, Agent, or Firm* — The Webb Law Firm

(57) ABSTRACT

This disclosure relates to an image display method and apparatus, an electronic device, a VR device, and a non-transitory computer-readable storage medium. An image display method applied to a VR device comprises: determining an activity state of the VR device according to measurement data of a sensor within the VR device; determining a processing mode of a current frame image to be displayed according to the activity state, wherein the processing mode is one of a flicker suppression process and a forwarding process; and processing the current frame image to be displayed according to the processing mode to obtain a current frame image for a display in the VR device, and sending it to the display.

10 Claims, 5 Drawing Sheets

(56) References Cited

U.S. PATENT DOCUMENTS

| | | | | |
|---|---|---|---|---|
| 2014/0092080 | A1* | 4/2014 | Fukunaga | G09G 3/3696 345/212 |
| 2014/0225978 | A1* | 8/2014 | Saban | G09F 19/16 348/14.07 |
| 2017/0160795 | A1* | 6/2017 | Hu | G06F 3/017 |
| 2017/0293356 | A1* | 10/2017 | Khaderi | G06F 3/147 |
| 2019/0012832 | A1* | 1/2019 | Sun | G06T 19/003 |
| 2020/0134792 | A1* | 4/2020 | Mandal | H04N 5/57 |

FOREIGN PATENT DOCUMENTS

| | | | |
|---|---|---|---|
| CN | 106598252 | A | 4/2017 |
| CN | 106973283 | A | 7/2017 |
| CN | 107707832 | A | 2/2018 |

* cited by examiner

IMAGE DISPLAY METHOD AND APPARATUS, ELECTRONIC DEVICE, VR DEVICE, AND NON-TRANSITORY COMPUTER READABLE STORAGE MEDIUM

CROSS-REFERENCE TO RELATED APPLICATIONS

This application claims priority to Chinese Patent Application No. 201910001425.7, which was filed on Jan. 2, 2019 and was entitled, "IMAGE DISPLAY METHOD AND APPARATUS, ELECTRONIC DEVICE, AND COMPUTER-READABLE STORAGE MEDIUM", and the disclosure of which is hereby incorporated by reference in its entirety for all purposes.

TECHNICAL FIELD

This disclosure relates to the field of control technology, and in particular, to an image display method and apparatus, an electronic device, a VR device, and a non-transitory computer-readable storage medium.

BACKGROUND

A flicker phenomenon will occur when a user views a display through an existing Virtual Reality (VR) device.

SUMMARY

According to a first aspect of this disclosure, an image display method applied to a VR device is provided, comprising:

determining an activity state of the VR device according to measurement data of a sensor within the VR device;

determining a processing mode of a current frame image to be displayed according to the activity state, wherein the processing mode is one of a flicker suppression process and a forwarding process; and processing the current frame image to be displayed according to the processing mode to obtain a current frame image for a display in the VR device, and sending it to the display.

Optionally, the activity state includes at least a still state and a moving state; and determining an activity state of the VR device according to measurement data of a sensor within the VR device comprises:

acquiring M measurement values collected by the sensor, wherein M is a positive integer greater than or equal to 2, and wherein each of the M measurement values comprises at least one of an angular velocity, a gravitational acceleration, and a geomagnetic angle of the VR device;

acquiring a standard deviation of the M measurement values; and determining that the VR device is in the still state if the standard deviation is smaller than a threshold K; and determining that the VR device is in the moving state if the standard deviation is greater than or equal to the threshold K.

Optionally, the activity state includes at least a still state and a moving state; and determining a processing mode of a current frame image to be displayed according to the activity state comprises:

determining that the processing mode of the current frame image to be displayed is the flicker suppression process if the activity state is the still state; and determining that the processing mode of the current frame image to be displayed is the forwarding process if the activity state is the moving state.

Optionally, if the processing mode is the flicker suppression process, processing the current frame image to be displayed according to the processing mode comprises: generating the current frame image for the display based on the current frame image to be displayed and one or more previous frame images to be displayed.

Optionally, if the processing mode is the flicker suppression process, processing the current frame image to be displayed according to the processing mode comprises:

determining whether the current frame image to be displayed is a first frame image in the still state;

if it is the first frame image, storing the first frame image into a first storage area and a third storage area, respectively; and if it is not the first frame image, storing the image in the first storage area into a second storage area and storing the current frame image to be displayed into the first storage area; and invoking a data conversion algorithm to process the image in the first storage area based on the image in the first storage area and the image in the second storage area, and storing the processed image into the third storage area;

wherein the first storage area, the second storage area, and the third storage area are areas divided in advance in a buffer of the VR device; and the image in the third storage area is the current frame image for the display.

Optionally, if the processing mode is the flicker suppression process, processing the current frame image to be displayed according to the processing mode comprises:

determining whether the current frame image to be displayed is a first frame image in the still state;

if it is the first frame image, storing the first frame image into a first storage area and an $(N+1)^{th}$ storage area, respectively; and if it is not the first frame image, sequentially storing the images in the first storage area through the $(N-1)^{th}$ storage area into the second storage area through the Nth storage area and storing the current frame image to be displayed in the first storage area; wherein N is a positive integer greater than or equal to 3; and invoking a data conversion algorithm to process the image in the first storage area based on the image in the first storage area through the image in the $N^{th}$ storage area, and storing the processed image in the $(N+1)^{th}$ storage area;

wherein the first storage area through the $(N+1)^{th}$ storage area are areas divided in advance in a buffer of the VR device; and the image in the $(N+1)^{th}$ storage area is the current frame image for the display.

Optionally, the data conversion algorithm comprises at least one of: a linear processing, an average value processing, a fitting processing, and a least square method processing.

Optionally, the data conversion algorithm is linear processing, and the formula is as follows:

$$I(x,y)=k1\times I1(x,y)+k2\times I2(x,y)+\ldots+kn\times In(x,y);$$
$$k1+k2+\ldots+kn=1;$$

wherein I (x, y) represents a pixel value of a pixel point on the processed image; I1 (x, y) represents a pixel value of a pixel point on an image stored in the first storage area, I2 (x, y) represents a pixel value of a pixel point on an image stored in the second storage area, In (x, y) represents a pixel value of a pixel point on an image stored in the $N^{th}$ storage area, and k1, k2, . . . , kn represent weight values of the pixel values in the first, second, . . . , and $N^{th}$ storage areas, respectively.

Optionally, if the processing mode is the forwarding process, processing the current frame image to be displayed according to the processing mode comprises:

forwarding the current frame image to be displayed to the display.

Optionally, the current frame image to be displayed is a frame image subjected to at least one of an image rendering process and a distortion correction process.

According to a second aspect of this disclosure, an image display apparatus applied to a VR device is provided, comprising:

an activity state determining module for determining an activity state of the VR device according to measurement data of a sensor within the VR device;

a processing mode determining module for determining a processing mode of a current frame image to be displayed according to the activity state, wherein the processing mode is one of a flicker suppression process and a forwarding process; and a display image processing module for processing the current frame image to be displayed according to the processing mode to obtain a current frame image for a display in the VR device, and sending it to the display.

Optionally, the activity state includes at least a still state and a moving state; and the activity state determining module comprises:

a measurement value acquiring submodule for acquiring M measurement values collected by the sensor, wherein M is a positive integer greater than or equal to 2, and wherein each of the M measurement values comprises at least one of an angular velocity, a gravitational acceleration, and a geomagnetic angle of the VR device;

a standard deviation acquiring submodule for acquiring a standard deviation of the M measurement values; and a state determining submodule for determining that the VR device is in the still state if the standard deviation is smaller than a threshold K; and determining that the VR device is in the moving state if the standard deviation is greater than or equal to the threshold K.

Optionally, the activity state includes at least a still state and a moving state; and the processing mode determining module comprises:

a still state determining submodule for determining that the processing mode of the current frame image to be displayed is the flicker suppression process if the activity state is the still state; and a moving state determining submodule for determining that the processing mode of the current frame image to be displayed is the forwarding process if the activity state is the moving state.

Optionally, if the processing mode is the flicker suppression process, the display image processing module comprises: an image generating submodule for generating the current frame image for the display based on the current frame image to be displayed and one or more previous frame images to be displayed.

Optionally, if the processing mode is the flicker suppression process, the display image processing module comprises:

an image determining submodule for determining whether the current frame image to be displayed is a first frame image in the still state;

an image storing submodule for, if it is the first frame image, storing the first frame image into a first storage area and a third storage area, respectively; and, if it is not the first frame image, storing the image in the first storage area into a second storage area and storing the current frame image to be displayed into the first storage area; and an image processing submodule for invoking a data conversion algorithm to process the image in the first storage area based on the image in the first storage area and the image in the second storage area, and storing the processed image into the third storage area;

wherein the first storage area, the second storage area and the third storage area are areas divided in advance in a buffer of the VR device; and the image in the third storage area is the current frame image for the display.

Optionally, if the processing mode is the flicker suppression process, the display image processing module comprises:

an image determining submodule for determining whether the current frame image to be displayed is a first frame image in the still state;

an image storing submodule for if it is the first frame image, storing the first frame image into a first storage area and an $(N+1)^{th}$ storage area, respectively; and if it is not the first frame image, sequentially storing the images in the first storage area through the $(N-1)^{th}$ storage area into the second storage area through the $N^{th}$ storage area and storing the current frame image to be displayed in the first storage area; wherein N is a positive integer greater than or equal to 3; and an image processing submodule for invoking a data conversion algorithm to process the image in the first storage area based on the image in the first storage area through the image in the $N^{th}$ storage area, and storing the processed image in the $(N+1)^{th}$ storage area;

wherein the first storage area through the $(N+1)^{th}$ storage area are areas divided in advance in a buffer of the VR device; and the image in the $(N+1)^{th}$ storage area is the current frame image for the display.

According to a third aspect of this disclosure, an electronic device is provided, comprising a display, a processor, and a memory for storing instructions executable by the processor;

wherein the processor reads from the memory and executes the executable instructions for implementing the method according to the first aspect.

According to a fourth aspect of this disclosure, an electronic device is provided, comprising a processor and a memory for storing instructions executable by the processor;

wherein the processor reads from the memory and executes the executable instructions for implementing the method according to the first aspect.

According to a fifth aspect of this disclosure, a non-transitory computer-readable storage medium having stored thereon computer instructions is provided, that, when executed by a processor, implement the method according to the first aspect.

According to a sixth aspect of this disclosure, a VR device is provided, comprising the apparatus according to the second aspect.

It is to be understood that both the foregoing general description and the following detailed description are merely exemplary and explanatory and cannot limit this disclosure.

BRIEF DESCRIPTION OF THE DRAWINGS

The accompanying drawings which are incorporated into and constitute a part of the specification show the embodiments of this disclosure, and together with the description, serve to explain the principle of this disclosure.

DETAILED DESCRIPTION

The exemplary embodiments will be described here in detail, examples of which are illustrated in the accompanying drawings. When the following description refers to the accompanying drawings, the same numerals in different drawings represent the same or similar elements unless otherwise indicated. The implementations described in the following exemplary embodiments do not represent all implementations consistent with this disclosure. Rather, they are merely examples of apparatuses and methods consistent with some aspects of this disclosure, as described in detail in the attached claims.

A flicker phenomenon will occur when a user views a display through the existing VR device, and particularly the flicker phenomenon is more evident when viewing in a still state. This is because, the sensor in the VR device still will make measurement in a still state, and involuntary shake of the user may drive the VR device to slightly shake, the slight shake of the VR device may cause a slight change in the measurement value of the sensor, which may cause a difference in pixel level of the rendered and displayed images, thereby causing a flicker phenomenon.

Therefore, some embodiments of this disclosure provide an image display method whose inventive concept lies in that, in the display process, a activity state of the VR device can be determined by using the measurement data collected by the sensor, and by adopting different image processing modes for the activity states of the VR device, the processed image to be displayed matches the activity state of the VR device, thereby avoiding the flicker phenomenon.

Figure 1:
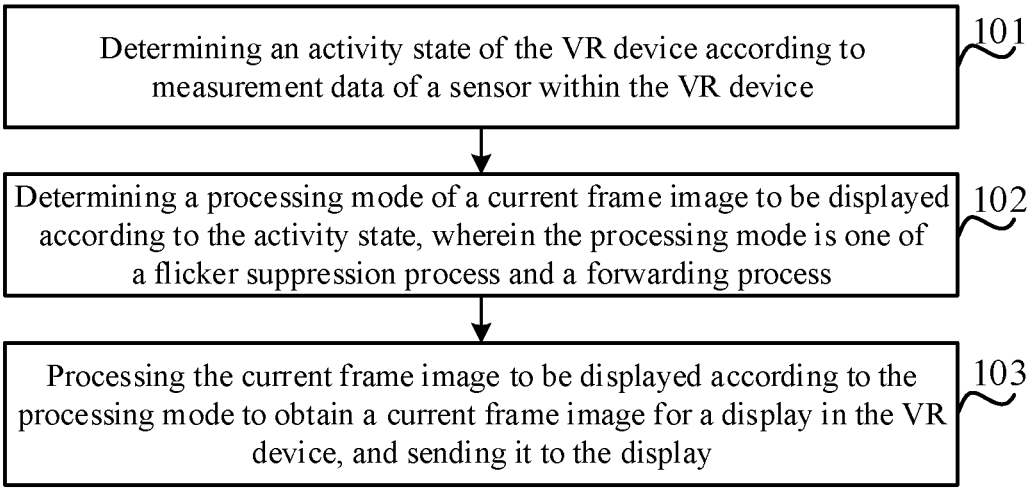
FIG. 1 is a flowchart showing an image display method according to some embodiments of this disclosure.

FIG. 1 is a flowchart showing an image display method according to some embodiments of this disclosure. Referring to FIG. 1, an image display method comprises steps 101 to 103, in which:

101, determining an activity state of the VR device according to measurement data of a sensor within the VR device.

Viewed from a hardware perspective, the VR device may comprise a modeling component (e.g., 3D scanner), a three-dimensional visual display component (e.g., 3D presentation device, projection device, etc.), a head-mounted stereoscopic display (e.g., binocular omni-directional display), a sound-producing component (e.g., three-dimensional sound device), an interaction device (e.g., including a position tracker, data gloves, etc.), a 3D input device (e.g., three-dimensional mouse), a motion capturing device, and other interactive devices, etc.

In some embodiments, the VR device may further comprise at least one of the following sensors as the motion capturing device: gyroscope, gravity acceleration sensor or geomagnetic meter. For example, the gyroscope can collect a current angular velocity of the VR device, the gravity acceleration sensor can collect a current gravity acceleration of the VR device, and the geomagnetic meter can collect a current geomagnetic angle of the VR device.

The sensors in the VR device can collect corresponding measurement data in real time or according to a set period, and store the measurement data in a specified location, wherein the specified location can be a local storage, a buffer or a cloud. Of course, the sensors may also send the measurement data directly to a processor in the VR device.

A processor in the VR device reads or receives the measurement data from the specified location, and can be determine an activity state of the VR device from the measurement data, wherein the activity state includes at least a still state and a moving state.

Figure 2:
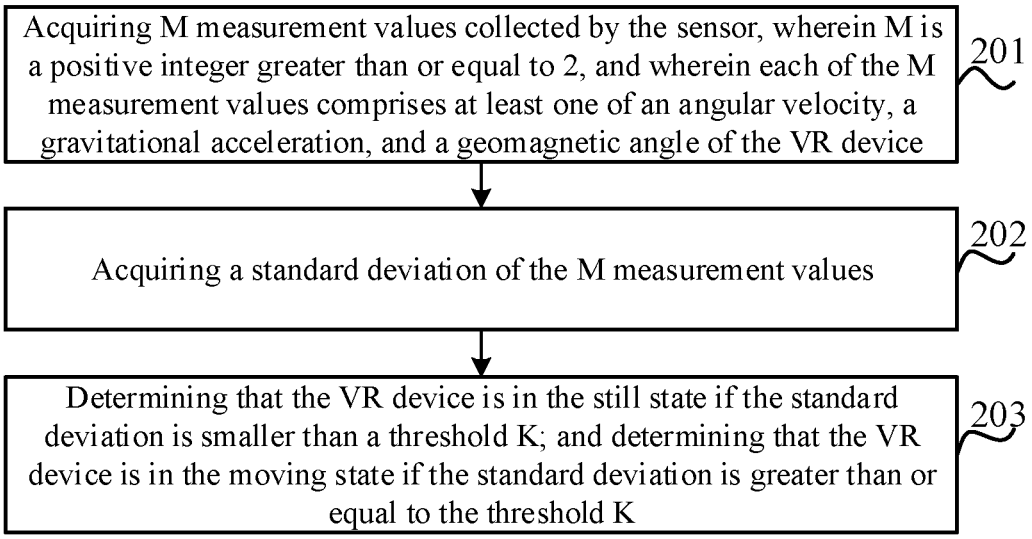
FIG. 2 is a flowchart showing a method of acquiring an activity state of a VR device according to some embodiments of this disclosure.

In some embodiments, referring to FIG. 2, determining the activity state of the VR device may comprise: acquiring by the processor the measurement data collected by the sensor, wherein the measurement data comprises M measurement values, wherein M is a positive integer greater than or equal to 2, and wherein each of the M measurement values comprises at least one of an angular velocity, a gravitational acceleration, and a geomagnetic angle of the VR device (corresponding to step 201). The processor may then acquire a standard deviation of the M measurement values (corresponding to step 202). Next, the processor calls a threshold K stored in advance, wherein the value of K can be set according to a scenario; and compares the standard deviation with the threshold K to obtain a comparison result. If the comparison result shows that the standard deviation is smaller than K, the processor can determine that the VR device is in a still state; if the comparison shows that the standard deviation is greater than or equal to K, the processor may determine that the VR device is in a moving state (corresponding to step 203).

It should be noted that, in step 202, the way of acquiring the standard deviation may be realized by using solutions in the related art, and is not limited herein. Of course, a skilled person may also substitute other parameters for the standard deviation, such as average value, variance, error, variation coefficient, etc., and the activity state of the VR device may be also determined through the values of the other parameters, and the corresponding solutions fall within the scope of protection of the present application.

It should be further noted that, in some embodiments, the activity state may be divided into a still state and a moving state, and certainly in some embodiments, the activity state may be further divided, by adjusting the value of the standard deviation, into, for example, an absolute still state, a relative still state, a small-amplitude moving state, a large-amplitude moving state, and the like, the solution of the present application can also be realized, and the corresponding solution falls within the scope of protection of the present application.

102, determining a processing mode of a current frame image to be displayed according to the activity state, wherein the processing mode is one of a flicker suppression process and a forwarding process.

In some embodiments, the processor in the VR device may determine the processing mode of the current frame image to be displayed according to the activity state.

The processing mode may be stored in the VR device in advance, and may include a flicker suppression process and a forwarding process. A specific process for the processing mode will be described in the following embodiments, and is not described herein.

In some embodiments, when the processor in the VR device is in the still state, by querying the pre-stored processing mode, it can be determined that the processing mode of the current frame image to be displayed is the flicker suppression process. When the processor is in the moving state, by querying the pre-stored processing mode, it can be determined that the processing mode of the current frame image to be displayed is the forwarding process.

It should be noted that the processing mode can also be stored in the cloud in the form of table, the processor can upload the activity state to the cloud through a communication interface, and the processing mode is fed back to the communication interface after the cloud queries the table and is transmitted to the processor through the communication interface; in this way, the solution of the present application can also be realized, and the corresponding solution also falls within the scope of protection of the present application.

In some embodiments, the current frame image to be displayed may be a frame image subjected to at least one of an image rendering process and a distortion correction process. The image rendering process and/or the distortion correction process may be executed based on the measurement data of the sensors within the VR device. There is no limitation on the order of execution of the image rendering process and the distortion correction process. The image rendering process and the distortion correction process are well-known image processing means, and are not described in detail herein.

103, processing the current frame image to be displayed according to the processing mode to obtain a current frame image for a display in the VR device, and sending it to the display.

In some embodiments, the processor in the VR device, after determining the processing mode, may process the current frame image to be displayed according to the processing mode, which comprises the following:

Firstly, if the activity state is the moving state, the processing mode is the forwarding process.

The processor forwards the current frame image to be displayed to the display in the VR device.

It should be noted that, in some embodiments, it is also possible to divide storage areas in advance in the local memory or the buffer, such as a first storage area, a second storage area, etc., to store the frame images to be displayed. The number of the storage areas may be set according to a specific scenario, and is not limited in the application.

Secondly, if the activity state is the still state, the processing mode is the flicker suppression process.

In some embodiments, the flicker suppression process may comprise: generating the current image frame for the display based on the current frame image to be displayed and one or more previous frame images to be displayed. More specifically, at least one of a linear process, an average process, a fitting process, and a least square process may be performed on the current frame image to be displayed and one or more previous frame images to be displayed to generate the current image frame for the display. Here, the one or more previous frame images to be displayed may be continuous frame images, evenly spaced frame images, or unevenly spaced frame images. In some embodiments, according to the number of frames of the images to be processed, the processing mode in which the processor processes the current frame image to be displayed may comprise the following scenarios.

In one embodiment, the number of frames of the images to be displayed which are to be processed by the processor is two, and in this case, three storage areas including a first storage area, a second storage area and a third storage area, shall be divided in advance in the buffer of the VR device. The image in the third storage area is the current frame image for the display, the image in the second storage area is a previous one frame of image to be displayed, and the image in the first storage area is the current frame image to be displayed which is to be processed.

Figure 3:
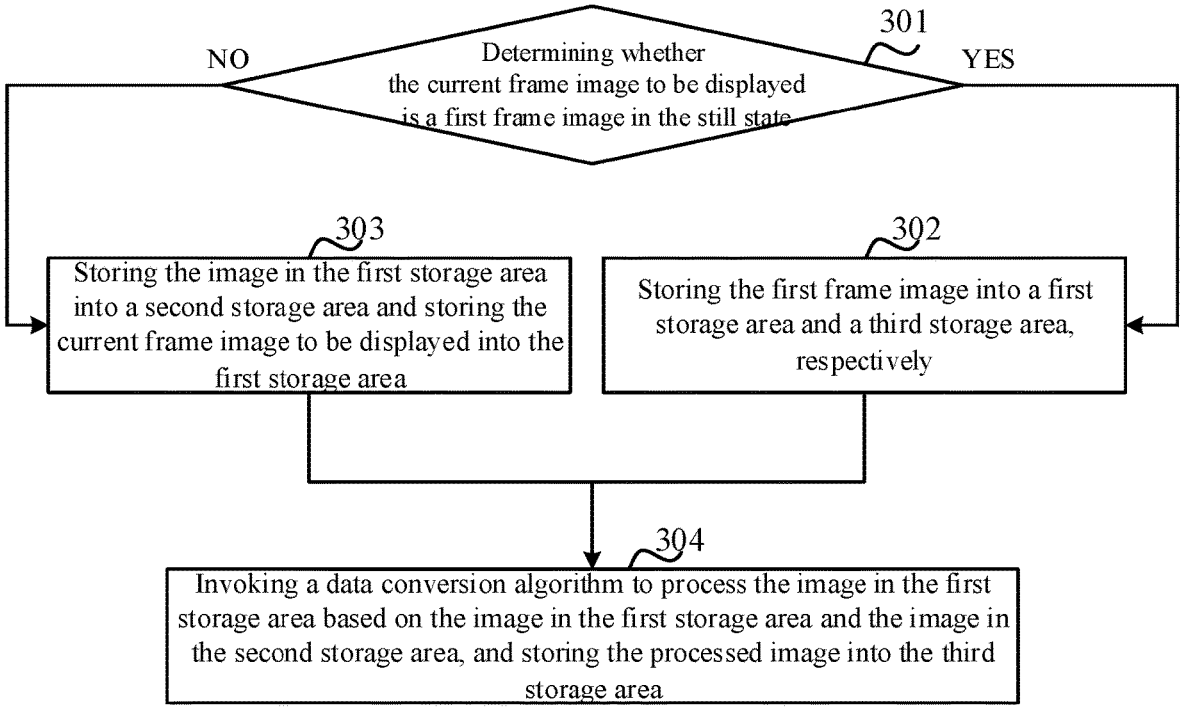
FIG. 3 is a flowchart showing a method of processing a current frame image to be displayed according to a flicker suppression processing according to some embodiments of this disclosure.

In this embodiment, referring to FIG. 3, the processor first determines whether the current frame image to be displayed is the first frame image in the still state (corresponding to step 301).

Continuing to refer to FIG. 3, if the current frame image to be displayed is the first frame image in the still state, the processor stores the first frame image into the first storage area and the third storage area, respectively (corresponding to step 302), wherein, the image in the third storage area is read and displayed by the display, or when the image needs to be displayed, the processor reads the image from the third storage area, sends the image to the display, and the image is displayed by the display.

Continuing to refer to FIG. 3, if the current frame image to be displayed is not the first frame image, but is for example the second, third, fourth, . . . , or $n^{th}$ frame image, the processor stores the image in the first storage area into the second storage area, and stores the current frame image to be displayed into the first storage area (corresponding to step 303). In other words, when the processor receives a new frame image to be displayed, it moves the images in the first storage area and the second storage area forward, then the image in the first storage area is transferred to the second storage area, the image in the second storage area is discarded, and thus the new frame image to be displayed can be stored in the first storage area.

Continuing to refer to FIG. 3, the processor may invoke a data conversion algorithm to process the image in the first storage area based on the image in the first storage area and the image in the second storage area, and the processed image is stored in the third storage area (corresponding to step 304). In other words, when the processor processes the current frame image to be displayed, it is based on the previous one frame of the image to be displayed, so that a change in the two adjacent frames of the image can be reduced, thereby reducing the probability of the occurrence of the flicker phenomenon in the display process.

In this embodiment, the data conversion algorithm includes at least one of the following: a linear process, an average value process, a fitting process, and a least square method process. In some scenarios, the data conversion algorithm employs the linear process and the formula is as follows:

$$I(x,y)=k1\times I1(x,y)+k2\times I2(x,y);\ k1+k2=1,\ \text{and}\ k1=0.7$$

wherein I (x, y) represents a pixel value of a pixel point on the processed image; I1 (x, y) represents a pixel value of a pixel point on an image stored in the first storage area, I2 (x, y) represents a pixel value of a pixel point on an image stored in the second storage area, and k1, k2 represent weight values of the pixel values in the first and second storage areas, respectively.

In another embodiment, the number of frames of the images to be displayed which are to be processed by the processor is N, wherein N is greater than or equal to 2. In this case, (N+1) storage areas shall be divided in advance in a buffer of the VR device, comprising a first storage area, a second storage area, . . . , $(N+1)^{th}$ storage area. The image in the $(N+1)^{th}$ storage area is the current frame image for the display, the one or more previous frame images to be displayed are sequentially stored in the $N^{th}$ storage area, the $(N-1)^{th}$ storage area, . . . , the second storage area, and the image in the first storage area is the current frame image to be displayed which is to be processed, wherein N is a positive integer.

Figure 4:
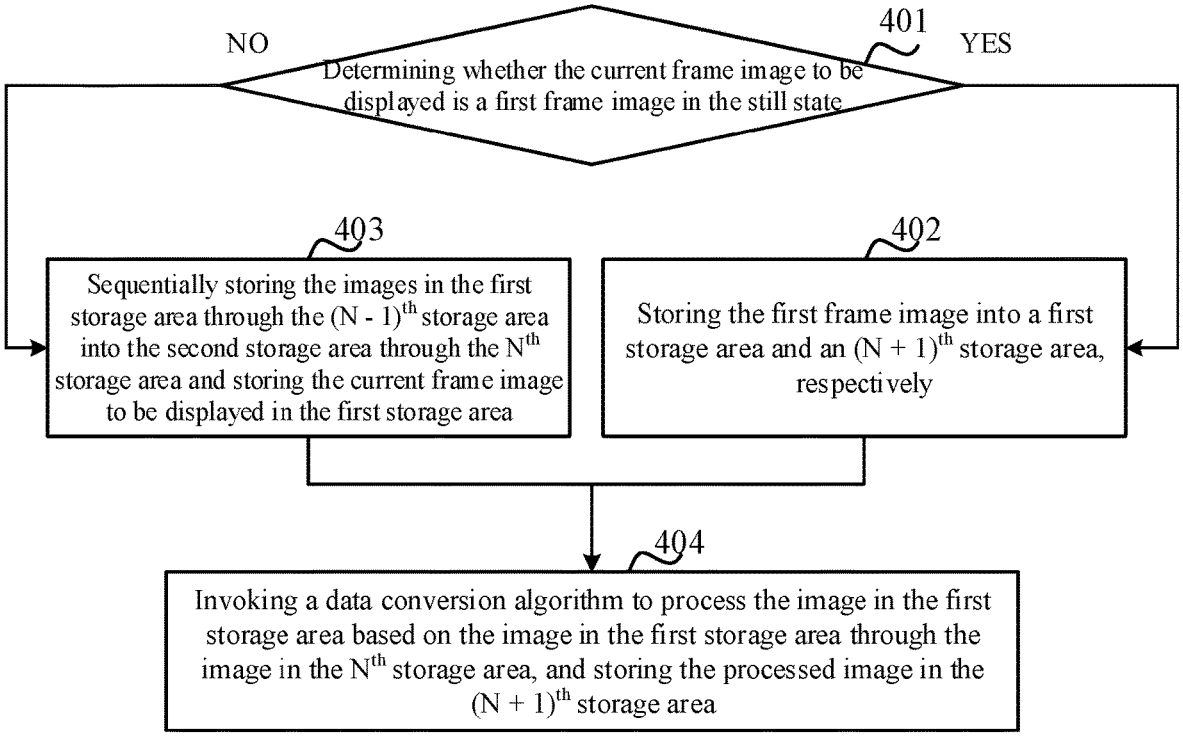
FIG. 4 is a flowchart showing another method of processing a current frame image to be displayed according to a flicker suppression processing according to some embodiments of this disclosure.

In this embodiment, referring to FIG. 4, the processor first determines whether the current frame image to be displayed is the first frame image in the still state (corresponding to step 401).

Continuing to refer to FIG. 4, if the current frame image to be displayed is the first frame image in a still state, the processor stores the first frame image into the first storage area and the $(N+1)^{th}$ storage area, respectively (corresponding to step 402), wherein, the image in the $(N+1)^{th}$ storage area is read and displayed by the display, or when the image needs to be displayed, the processor reads the image from the $(N+1)^{th}$ storage area, sends the image to the display and the image is displayed by the display.

Continuing to refer to FIG. 4, if the current frame image to be displayed is not the first frame image, but is for example the second, the third, the fourth, . . . , and $N^{th}$ frame image, the processor sequentially moves the images in the first storage area, the second storage area, . . . , and the $N^{th}$ storage area forward, i.e., discards the image in the $N^{th}$ storage area, stores the image in the $(N-1)^{th}$ storage area into the $N^{th}$ storage area, stores the image in the $(N-2)^{th}$ storage area into the $(N-1)^{th}$ storage area, . . . , stores the image in the first storage area into the second storage area, and stores the current frame image to be displayed into the first storage area (corresponding to step 403). In other words, when the processor receives a new frame image to be displayed, the processor moves the images in respective storage areas forward, the image in the $N^{th}$ storage area is discarded, and the new frame image to be displayed is stored in the first storage area.

Continuing to refer to FIG. 4, the processor may invoke a data conversion algorithm to process the image in the first storage area based on the images in the first storage area, the second storage area, . . . , and the $N^{th}$ storage area, and store the processed image into the $(N+1)^{th}$ storage area (corresponding to step 404). In other words, the processor processes the current frame image to be displayed based on the (N−1) previous frame image(s) to be displayed, so that the new frame image to be displayed can be correlated with the (N−1) previous frame image(s), and a change between the new frame image to be displayed and the (N−1) previous frame image(s) can be reduced, thereby reducing the probability of the occurrence of the flicker phenomenon in the display process.

In this embodiment, the linear process is continued to be used as an example of the data conversion algorithm, and the formula is as follows:

$$I(x,y)=k1\times I1(x,y)+k2\times I2(x,y)+\ldots+kn\times In(x,y);$$
$$k1+k2+\ldots+kn=1;$$

wherein I (x, y) represents a pixel value of a pixel point on the processed image; I1 (x, y) represents a pixel value of a pixel point on an image stored in the first storage area, I2 (x, y) represents a pixel value of a pixel point on an image stored in the second storage area, In (x, y) represents a pixel value of a pixel point on an image stored in the Nth storage area, and k1, k2, . . . , kn represent weight values of the pixel values in the first, second, . . . , and Nth storage areas, respectively.

So far, in the embodiments of the disclosure, the measurement data of the sensors within the VR device can be acquired, and then the activity state of the VR device is determined according to the measurement data of the sensors within the VR device; the processing mode of the current frame image to be displayed is determined according to the activity state, wherein the processing mode is one of the flicker suppression process and the forwarding process; and finally, the current frame image to be displayed is processed according to the processing mode to obtain the current frame image for the display in the VR device, which is sent to the display. It follows that, in some embodiments, the processing mode of the current frame image to be displayed is determined according to the activity state of the VR device, for example, if the activity state of the VR device is the still state, the current frame image to be displayed is processed according to the flicker suppression process, and if the activity state is the moving state, the current frame image to be displayed is processed according to the forwarding process, so that the processed image for the display is adapted to the activity state of the VR device, the flicker phenomenon in the display process is avoided, and the viewing experience is improved.

Figure 5:
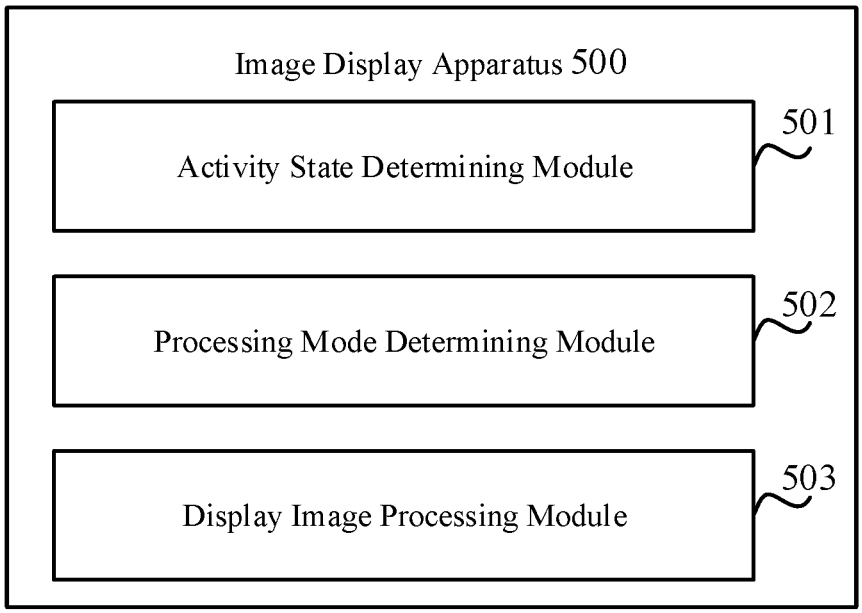
FIGS. 5-9 are block diagrams showing an image display apparatus according to some embodiments of this disclosure.

This disclosure further provides an image display apparatus, and FIG. 5 is a block diagram of the image display apparatus provided according to some embodiments of this disclosure. Referring to FIG. 5, an image display apparatus 500 applied to a VR device may comprise:

an activity state determining module 501 for determining an activity state of the VR device according to measurement data of a sensor within the VR device;

a processing mode determining module 502 for determining a processing mode of a current frame image to be displayed according to the activity state, wherein the processing mode is one of a flicker suppression process and a forwarding process; and a display image processing module 503 for processing the current frame image to be displayed according to the processing mode to obtain a current frame image for a display in the VR device, and sending it to the display.

So far, in some embodiments, the processing mode of the current frame image to be displayed is determined according to the activity state of the VR device, for example, if the activity state of the VR device is a still state, the current frame image to be displayed is processed according to the flicker suppression process, and if the activity state is a moving state, the current frame image to be displayed is processed according to the forwarding process, so that the processed image for the display is adapted to the activity state of the VR device, the flicker phenomenon in the display process is avoided, and the viewing experience is improved.

Figure 6:
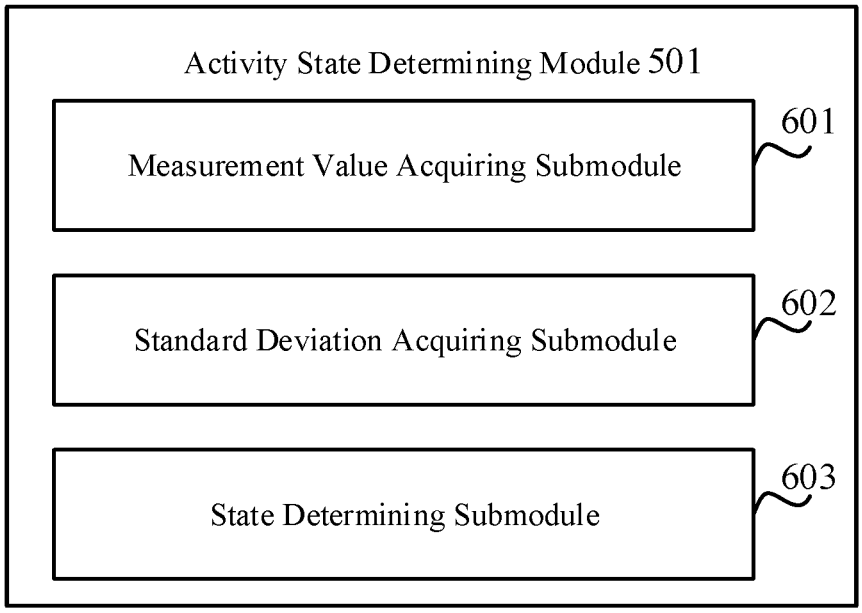

In some embodiments, the activity state includes at least the still state and the moving state, and on the basis of the image display apparatus 500 shown in FIG. 5, referring to FIG. 6, the activity state determining module 501 may comprise:

a measurement value acquiring submodule 601 for acquiring M measurement values collected by the sensor, wherein M is a positive integer greater than or equal to 2, and wherein each of the M measurement values comprises at least one of an angular velocity, a gravitational acceleration, and a geomagnetic angle of the VR device;

a standard deviation acquiring submodule 602 for acquiring a standard deviation of the M measurement values; and a state determining submodule 603 for determining that the VR device is in the still state if the standard deviation is smaller than a threshold K; and determining that the VR device is in the moving state if the standard deviation is greater than or equal to the threshold K.

Figure 7:
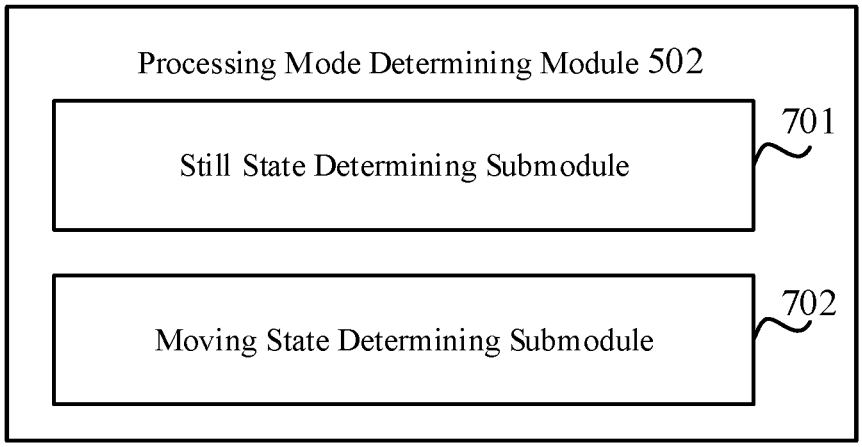

In some embodiments, the activity state includes at least the still state and the moving state, and on the basis of the image display apparatus 500 shown in FIG. 5, referring to FIG. 7, the processing mode determining module 502 may comprise:

a still state determining submodule 701 for determining that the processing mode of the current frame image to be displayed is the flicker suppression process if the activity state is the still state; and a moving state determining submodule 702 for determining that the processing mode of the current frame image to be displayed is the forwarding process if the activity state is the moving state.

In some embodiments, on the basis of the image display apparatus 500 shown in FIG. 5, if the processing mode is the flicker suppression process, the display image processing module 503 may comprise: an image generating submodule for generating the current frame image for the display based on the current frame image to be displayed and one or more previous frame images to be displayed. Here, the image generating submodule may comprise an image determining submodule 801 or 901, an image storing submodule 802 or 902, and an image processing submodule 803 or 903, which are described later.

Figure 8:
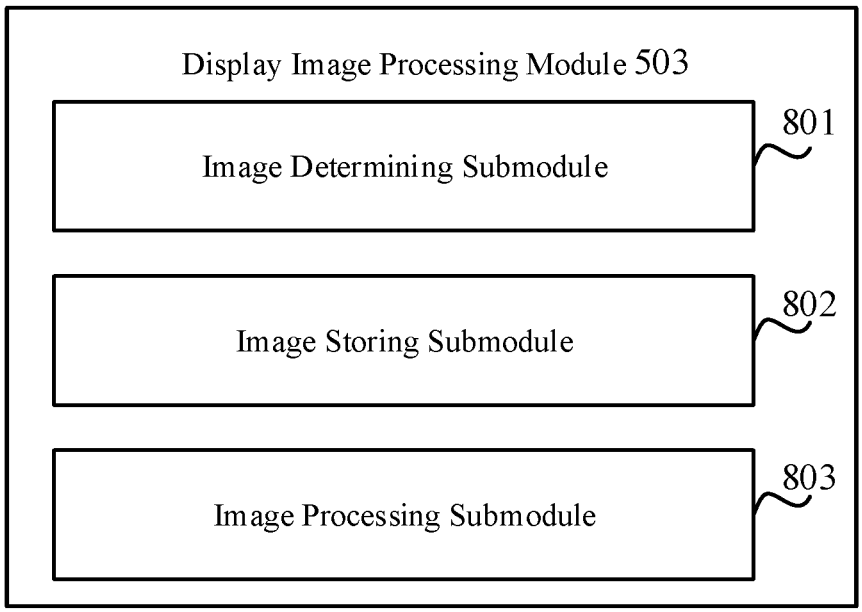

In some embodiments, referring to FIG. 8, if the processing mode is the flicker suppression process, the display image processing module 503 may comprise:

an image determining submodule 801 for determining whether the current frame image to be displayed is a first frame image in the still state;

an image storage submodule 802 for, if it is the first frame image, storing the first frame image into a first storage area and a third storage area, respectively; and, if it is not the first frame image, storing the image in the first storage area into a second storage area and storing the current frame image to be displayed into the first storage area; and an image processing submodule 803 for invoking a data conversion algorithm to process the image in the first storage area based on the image in the first storage area and the image in the second storage area, and storing the processed image into the third storage area;

wherein the first storage area, the second storage area and the third storage area are areas divided in advance in a buffer of the VR device; and the image in the third storage area is the current frame image for the display.

Figure 9:
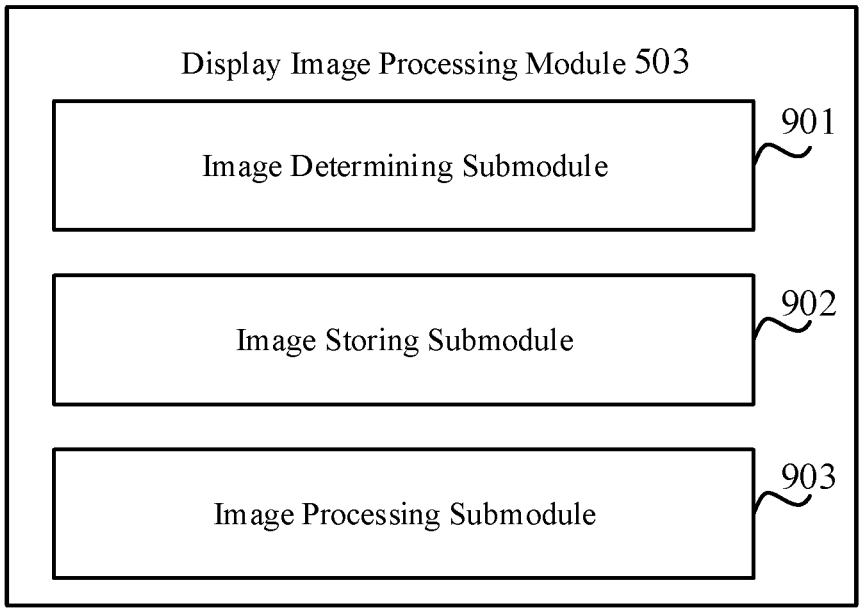

In some embodiments, referring to FIG. 9, if the processing mode is the flicker suppression process, the display image processing module 503 may comprise:

an image determining submodule 901 for determining whether the current frame image to be displayed is a first frame image in the still state;

an image storing submodule 902 for, if it is the first frame image, storing the first frame image into a first storage area and an $(N+1)^{th}$ storage area, respectively; and if it is not the first frame image, sequentially storing the images in the first storage area through the $(N-1)^{th}$ storage area into the second storage area through the $N^{th}$ storage area and storing the current frame image to be displayed in the first storage area, wherein N is a positive integer greater than or equal to 2; an image processing submodule 903 for invoking a data conversion algorithm to process the image in the first storage area based on the image in the first storage area through the image in the $N^{th}$ storage area, and storing the processed image in the $(N+1)^{th}$ storage area;

wherein the first storage area through the $(N+1)^{th}$ storage area are areas divided in advance in a buffer of the VR device; and the image in the $(N+1)^{th}$ storage area is the current frame image for the display.

Each of the modules or submodules in the apparatus 500 described above may be implemented by a processor that reads and executes instructions of one or more application programs. More specifically, the activity state determining module 501 may be implemented, for example, by the processor when executing an application program having instructions to perform step 101. The processing mode determining module 502 may be implemented, for example, by the processor when executing an application program having instructions to perform step 102. The display image processing module 503 may be implemented, for example, by the processor when executing an application program having instructions to perform step 103. Similarly, the aforementioned submodules 601-603 may be implemented, for example, by the processor when executing an application program having instructions to perform steps 201-203. The aforementioned submodules 801-803 may be implemented, for example, by the processor when executing an application program having instructions to perform steps 301-304. The aforementioned submodules 901-903 may be implemented, for example, by the processor when executing an application program having instructions to perform steps 401-404. Executable codes or source codes of the instructions of software elements may be stored in a non-transitory computer-readable storage medium, such as one or more memories. Executable codes or source codes of the instructions of the software elements may also be downloaded from a remote location.

It will be apparent to those skilled in the art from the above-described embodiments that this disclosure can be realized by software using necessary hardware, or by hardware, firmware, or the like. Based on this understanding, embodiments of this disclosure may be partially implemented in software. The computer software may be stored in a non-transitory readable storage medium such as a floppy disk, a hard disk, an optical disk, or a flash memory of a computer. The computer software includes a series of instructions that cause a computer (e.g., a personal computer, a server, or a network terminal) to perform a method according to various embodiments of this disclosure, or a portion thereof.

Some embodiments of this disclosure further provide an electronic device comprising a display 1004, a processor 1001, and a memory 1002 for storing instructions executable by the processor 1001;

wherein the processor 1001 is connected to the memory 1002 via a communication bus 1003, and the processor 1001 can read and execute executable instructions from the memory 1002 to implement the methods shown in FIGS. 1 to 4. The process of executing the executable instructions by the processor may refer to FIG. 1 through FIG. 4, and are not repeated here.

The processor 1001 may be any kind of processor and may include, but is not limited to, one or more general purpose processors and/or one or more special purpose processors (such as a special purpose processing chip). The memory 1002 may be non-transitory and may be any storage device that implements a data library and may include, but is not limited to, disk drive, optical storage device, solid state storage, floppy disk, flexible disk, hard disk, magnetic tape or any other magnetic media, compact disk or any other optical media, ROM (Read Only Memory), RAM (Random Access Memory), cache memory and/or any other memory chips or cartridges, and/or any other medium from which a computer can read data, instructions, and/or code. The memory 1002 may be removable from the interface. Bus 1003 may include, but is not limited to, an Industry Standard Architecture (ISA) bus, a Micro Channel Architecture (MCA) bus, an Enhanced ISA (EISA) bus, a Video Electronics Standards Association (VESA) local bus, and a Peripheral Component Interconnect (PCI) bus. Display 1004 may include, but is not limited to, a Cathode Ray Tube (CRT) display, a Liquid Crystal Display (LCD), and a light emitting diode display (LED). Display 1004 may include a 3D display.

Figure 10:
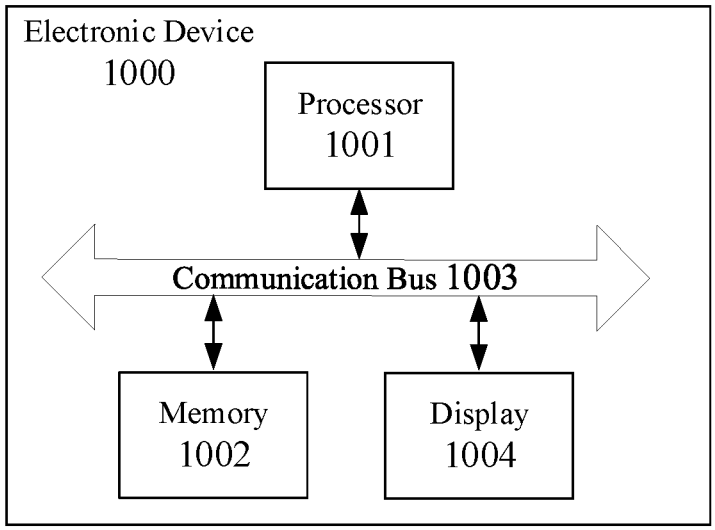
FIG. 10 is a block diagram showing an electronic device according to some embodiments of this disclosure.

In some embodiments, the display 1004 shown in FIG. 10 is not a necessary component. In some embodiments, the electronic device 1000 may not include the display 1004, but rather, the electronic device 1000 sends the processed image to the display 1004 which is external to the electronic device 1000.

Some embodiments of this disclosure further provide a VR device comprising the image display apparatus shown in FIGS. 5 to 9.

Some embodiments of this disclosure further provide a non-transitory computer-readable storage medium having computer instructions stored thereon that, when executed by a processor, implement the methods shown in FIGS. 1-4. The process of executing the executable instructions by the processor may refer to FIGS. 1 to 4, and is not repeated here. It should be noted that the readable storage medium may be applied to a VR device, an imaging device, an electronic device, and the like, and the skilled person may select it according to a specific scenario, which is not limited herein.

In this disclosure, the terms "first" and "second" are used for descriptive purposes only but cannot be construed as indicating or implying a relative importance. The term "plurality" means two or more, unless expressly defined otherwise.

Other embodiments of this disclosure will be apparent to those skilled in the art after considering the specification and practicing the disclosure disclosed herein. This disclosure is intended to cover any variations, uses, or adaptations of this disclosure, and these variations, uses, or adaptations follow general principles of this disclosure and include common knowledge or customary technical means in the art, not disclosed in this disclosure. It is intended that the specification and embodiments are considered as exemplary only, with a true scope and spirit of this disclosure being indicated by the attached claims.

It is to be understood that this disclosure is not limited to the precise arrangements described above and illustrated in the drawings, and that various modifications and variations may be made without departing from the scope thereof. The scope of this disclosure is to be limited only by the attached claims.

What is claimed is:

1. An image display method applied to a Virtual Reality (VR) device, comprising:

determining an activity state of the VR device according to measurement data of a sensor within the VR device;

determining a processing mode of a current frame image to be displayed according to the activity state, wherein the processing mode is one of a flicker suppression process and a forwarding process; and processing the current frame image to be displayed according to the processing mode to obtain a current frame image for a display in the VR device, and sending the current frame image for the display to the display, wherein the activity state includes at least a still state and a moving state; and determining the processing mode of the current frame image to be displayed according to the activity state comprises:

determining that the processing mode of the current frame image to be displayed is the flicker suppression process if the activity state is the still state; and, determining that the processing mode of the current frame image to be displayed is the forwarding process if the activity state is the moving state, and wherein, if the processing mode is the flicker suppression process, processing the current frame image to be displayed according to the processing mode comprises:

determining whether the current frame image to be displayed is a first frame image in the still state;

if the current frame image to be displayed is the first frame image, storing the first frame image into a first storage area and an $(N+1)^{th}$ storage area, respectively; and if the current frame image to be displayed is not the first frame image, sequentially storing images in the first storage area through an $(N-1)^{th}$ storage area into a second storage area through an $N^{th}$ storage area and storing the current frame image to be displayed in the first storage area; wherein N is a positive integer greater than or equal to 2; and invoking a data conversion algorithm to process the image in the first storage area based on the image in the first storage area through the image in the $N^{th}$ storage area, and storing the processed image in the $(N+1)^{th}$ storage area, wherein the first storage area through the $(N+1)^{th}$ storage area are areas divided in advance in a buffer of the VR device; and the image in the $(N+1)^{th}$ storage area is the current frame image for the display.

2. The image display method according to claim 1, wherein the activity state includes at least a still state and a moving state; and determining the activity state of the VR device according to measurement data of a sensor within the VR device comprises:

acquiring M measurement values collected by the sensor, wherein M is a positive integer greater than or equal to 2, and wherein each of the M measurement values comprises at least one of an angular velocity, a gravitational acceleration, and a geomagnetic angle of the VR device;

acquiring a standard deviation of the M measurement values; and determining that the VR device is in the still state if the standard deviation is smaller than a threshold K; and determining that the VR device is in the moving state if the standard deviation is greater than or equal to the threshold K.

3. The image display method according to claim 1, wherein the data conversion algorithm comprises at least one of: a linear processing, an average value processing, a fitting processing, and a least square method processing.

4. The image display method according to claim 1, wherein the data conversion algorithm is a linear processing, and a formula is as follows:

$$I(x,y)=k1\times I1(x,y)+k2\times I2(x,y)+\ldots+kn\times In(x,y);$$
$$k1+k2+\ldots+kn=1;$$

wherein I (x, y) represents a pixel value of a pixel point on the processed image; I1 (x, y) represents a pixel value of a pixel point on an image stored in the first storage area, I2 (x, y) represents a pixel value of a pixel point on an image stored in the second storage area, In (x, y) represents a pixel value of a pixel point on an image stored in the Nth storage area, and k1, k2, . . . kn represent weight values of the pixel values in the first, second, . . . , and Nth storage areas, respectively.

5. The image display method according to claim 1, wherein if the processing mode is the forwarding process, processing the current frame image to be displayed according to the processing mode comprises:

forwarding the current frame image to be displayed to the display.

6. The image display method according to claim 1, wherein the current frame image to be displayed is a frame image subjected to at least one of an image rendering process and a distortion correction process.

7. A non-transitory computer-readable storage medium having stored thereon computer instructions, that, when executed by a processor, implement the method according to claim 1.

8. An image display apparatus applied to a Virtual Reality (VR) device, comprising at least one processor and a memory for storing one or more instructions executable by the processor that, when executed by the at least one processor, cause the at least one processor to:

determine an activity state of the VR device according to measurement data of a sensor within the VR device;

determine a processing mode of a current frame image to be displayed according to the activity state, wherein the processing mode is one of a flicker suppression process and a forwarding process; and process the current frame image to be displayed according to the processing mode to obtain a current frame image for a display in the VR device, and send the current frame image for the display to the display, wherein the activity state includes at least a still state and a moving state; and the executable instructions to determine the processing mode, further cause the at least one processor to:

determine that the processing mode of the current frame image to be displayed is the flicker suppression process if the activity state is the still state; and determine that the processing mode of the current frame image to be displayed is the forwarding process if the activity state is the moving state, and wherein, if the processing mode is the flicker suppression process, executable instructions to process the current frame image to be displayed, further cause the at least one processor to:

determine whether the current frame image to be displayed is a first frame image in the still state;

store the first frame image, if the current frame image to be displayed is the first frame image, into a first storage area and an $(N+1)^{th}$ storage area, respectively; and if the current frame image to be displayed is not the first frame image, sequentially store the images in the first storage area through the $(N-1)^{th}$ storage area into the second storage area through the $N^{th}$ storage area and store the current frame image to be displayed in the first storage area; wherein N is a positive integer greater than or equal to 2; and invoke a data conversion algorithm to process the image in the first storage area based on the image in the first storage area through the image in the $N^{th}$ storage area, and store the processed image in the $(N+1)^{th}$ storage area;

wherein the first storage area through the $(N+1)^{th}$ storage area are areas divided in advance in a buffer of the VR device; and the image in the $(N+1)^{th}$ storage area is the current frame image for the display.

9. The image display apparatus according to claim 8, wherein the activity state includes at least a still state and a moving state; and the memory includes executable instructions to determine the activity state, which further cause the processor to:

acquire M measurement values collected by the sensor, wherein M is a positive integer greater than or equal to 2, and wherein each of the M measurement values comprises at least one of an angular velocity, a gravitational acceleration, and a geomagnetic angle of the VR device;

acquire a standard deviation of the M measurement values; and determine that the VR device is in the still state if the standard deviation is smaller than a threshold K; and determining that the VR device is in the moving state if the standard deviation is greater than or equal to the threshold K.

10. A Virtual Reality (VR) device, comprising the apparatus according to claim 8.

* * * * *